United States Patent [19]

Clouse

[11] 4,335,685

[45] Jun. 22, 1982

[54] LIFTER ASSEMBLY

[75] Inventor: Jerry A. Clouse, Washington, Ill.

[73] Assignee: Caterpillar Tractor Co., Peoria, Ill.

[21] Appl. No.: 108,906

[22] PCT Filed: Oct. 19, 1979

[86] PCT No.: PCT/US79/00867

§ 371 Date: Oct. 19, 1979

§ 102(e) Date: Oct. 19, 1979

[51] Int. Cl.[3] ..... F01L 1/10

[52] U.S. Cl. ..... 123/90.5; 123/90.48; 123/90.49

[58] Field of Search ..... 123/90.48, 90.49, 495, 123/90.50

[56] References Cited

U.S. PATENT DOCUMENTS

| | | | |
|---|---|---|---|
| 1,565,223 | 12/1925 | Church | 123/90.5 |
| 1,802,330 | 4/1931 | Boland | 123/90.5 |
| 3,523,459 | 8/1970 | Mowbray | 123/90.48 |
| 3,822,683 | 7/1974 | Clouse | 123/90.5 |
| 4,089,234 | 5/1978 | Henson | 123/90.5 |

FOREIGN PATENT DOCUMENTS

| | | | |
|---|---|---|---|
| 33271 | 7/1934 | Netherlands | 123/90.48 |

*Primary Examiner*—Ronald H. Lazarus

*Attorney, Agent, or Firm*—Phillips, Moore, Weissenberger, Lempio & Majestic

[57] ABSTRACT

Conventional lifter assemblies are relatively expensive to manufacture and generally extend laterally significantly beyond the ends of the roller surface thereof. As a result, fuel pumps utilizing such conventional assemblies must be spaced relatively far apart so that a sufficient roller surface is provided to contact a camshaft. Further, such assemblies are generally relatively heavy, leading to high inertial changes on reciprocation thereof. The ends (42,43 or 142,143) of the roller (14 or 114) are adjacent the inner diameter of the sleeve (28 or 128), whereby the roller (14 or 114) of the resulting lifter assembly (10) extends nearly the full width thereof. A roller holder (30 or 130) fits within one end (32 or 132) of the sleeve (28 or 128) and holds the roller (14 or 114) in a cavity (36 or 136) therein.

12 Claims, 4 Drawing Figures

LIFTER ASSEMBLY

DESCRIPTION

LIFTER ASSEMBLY

1 Technical Field

This invention relates to a lifter assembly for a fuel pump plunger and to a method of manufacturing the assembly and an individual part thereof.

2 Background Art

Generally, lifter assemblies for fuel pumps include a support structure formed from a casting or a piece of barstock or the like by a series of machining operations. A roller is included as a part of such a lifter assembly to engage an engine-driven camshaft. The ends of the roller may have smaller diameters than the center portion thereof, and only the center portion serves for bearing engagement with the camshaft. The reduced diameter pin ends are rotatably mounted in bores formed in the support structure.

Alternatively, the roller may be rotatably mounted on a pin having its ends fixedly mounted on the support structure. In either case, the support structure must be relatively thick, and the roller or pin ends must be relatively long to bear the loads to which they are subjected. The length of the bearing surface of the roller which engages the camshaft is thereby reduced by the necessity of having the roller supported by the relatively massive support structure.

There is considerable stress at the point of contact of the roller with the camshaft. Thus, it is important that the roller be of at least some minimum width if such stress is to be kept at an acceptable level. In order to attain the necessary minimum width for the roller, adjacent prior art roller followers have had to be placed a sufficiently spaced distance from one another to allow mounting of the pin ends to the support structure. This has often created spacing problems in the engine structure.

One attempt to solve some of the problems are discussed above is set out in U.S. Pat. 3,822,683, issued July 9, 1974 to Jerry A. Clouse. In this patent, a roller follower is described which utilizes a cylindrical member in which a roller bearing is rotatably mounted. A clip fits in opposed slots in the cylindrical member with foot portions of the clip being in position to retain the ends of the roller bearing. In the apparatus of this patent, the roller does not have a reduced diameter pin end and can extend generally the entire distance from one foot portion to the other of the clip. However, the walls defining the slots in which the clip sits protrude significantly outwardly from the ends of the roller. Thus, sufficient overall saving in roller follower size is not attained. Also, the slots must be mechined into the cylindrical member or must otherwise be provided therein. Further, the cylindrical member is relatively heavy since it extends from the roller over the entire length of the roller follower. Thus, inertial changes are relatively great on reversal of the direction of movement of the roller follower. Still further, due to the solid construction of the cylindrical member, a window cannot readily be formed therein for entry of a rack to rotate a fuel pump plunger. Indeed, in the patent disclosing the just discussed roller follower, the rack motivates the fuel pump plunger a spaced distance above the roller follower.

Even if one has enough space in an engine to place the roller followers well apart, there is still a significant problem of cost and time in preparing the aforementioned support structures. That is, such machining operations as have been alluded to clearly add significantly to the cost of the overall roller follower.

DISCLOSURE OF INVENTION

The present invention is directed to overcoming one or more of the problems as set forth above.

In one aspect of the present invention, a lifter assembly is disclosed for a fuel pump plunger. The assembly comprises a sleeve having a lateral window therethrough; a roller holder fitting within said sleeve from a first end thereof, said holder having a semi-cylindrical cavity therein orthogonal to the axis of said sleeve and opening generally at said sleeve first end; and a roller rotatingly mounted in said cavity with the ends thereof within the sleeve.

One embodiment of the invention relates to a method of forming a sleeve having a lateral window therethrough. The method comprises forming the window through a generally rectangular metal blank having at least one pair of generally parallel edges, and curling over the piece of metal until the generally parallel edges abut to form the sleeve.

The above set out method provides a very inexpensive way of forming a sleeve which can serve as the support section of a roller follower. If a roller holder is fitted within such a sleeve from a first end thereof, and the roller follower has the required cavity with the roller rotatingly mounted therein, and with the ends thereof adjacent the internal diameter of the sleeve, then the effective roller surface becomes nearly the length of the entire lifter assembly. This is so since there are no ends of the roller which need fit in either bearing or fixed relation in appropriate openings in the support structure, and since the sleeve is generally relatively thin. This allows such lifter assemblies to be mounted relatively close to one another, thus saving needed space in an engine. Also, since the holder generally only extends a fraction of the length of the sleeve and the sleeve is relatively thin, the overall weight of the roller follower is low compared to common prior art structures.

BEST MODE FOR CARRYING OUT THE INVENTION THE APPARATUS

Figure 1:
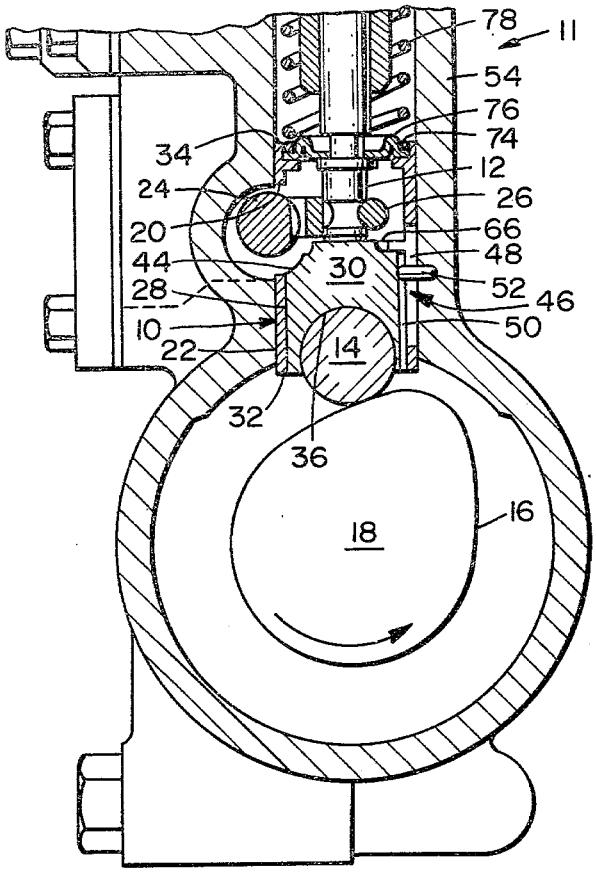
FIG. 1 illustrates, in front section view, an embodiment in accordance with the present invention in its use environment.

Adverting to FIG. 1, there is illustrated therein a lifter assembly 10 in accordance with the present invention for use in a fuel pump 11. The lifter assembly 10 serves for motivating a fuel pump plunger 12 to move reciprocally, as a roller 14 of the assembly 10 rolls along a surface 16 of a camshaft 18. A window 20 is provided through a lateral side 22 of the lifter assembly 10. The window serves to admit a motivator, such as a rack 24, to engage with a collar 26 which is fastened about the plunger 12. As the rack 24 moves linearly, the collar 26, and with it the plunger 12, is caused to rotate, thereby adjusting the operation of the fuel pump 11. For example, the timing, and/or the volume of fuel delivered may be adjusted in this manner.

Figure 2:
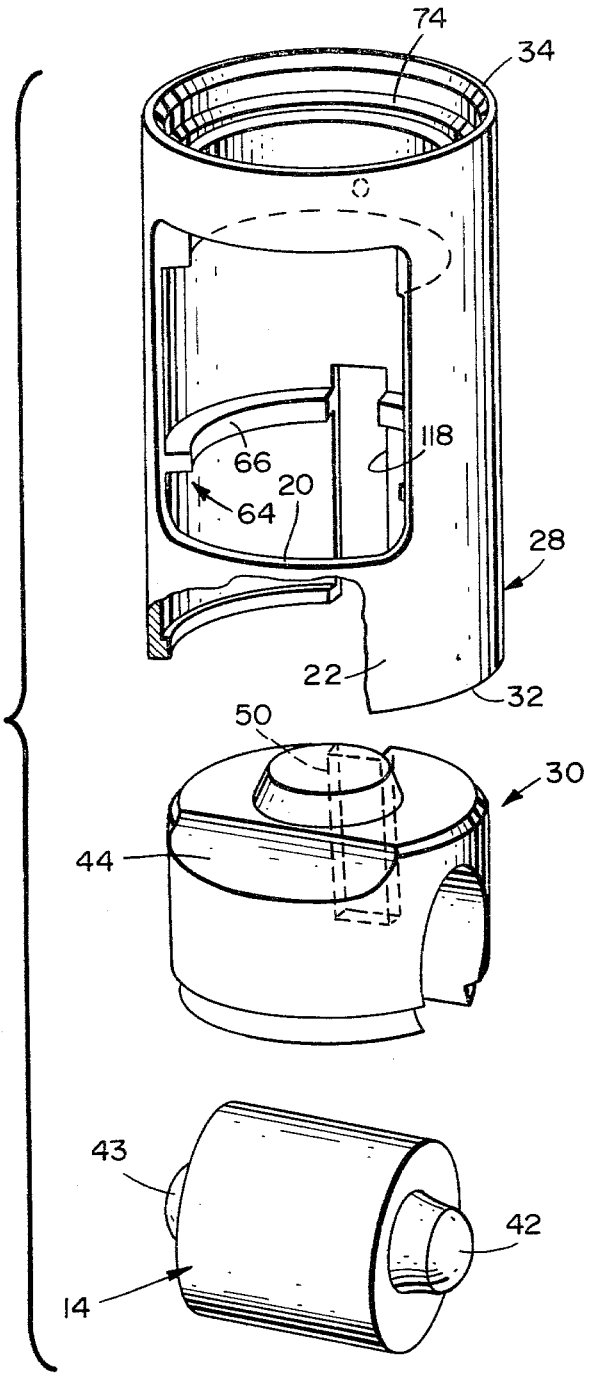
FIG. 2 illustrates, in enlarged exploded perspective view, an alternate embodiment in accordance with the present invention.

In accordance with the present invention, a particular lifter assembly 10 is illustrated, both in FIG. 1 and in FIG. 2. The lifter assembly 10, in accordance with the present invention, includes a sleeve 28 which serves as a support structure for the roller 14 in a manner which will shortly become apparent. The window 20 in accordance with the present invention is formed through the lateral side 22 of the sleeve 28.

A roller holder 30 is removably fitted within the sleeve 28 from a first end 32 thereof towards a second end 34 thereof. The roller holder 30 extends to adjacent the window 20 but is of a construction not to interfere with the action of the rack 24 in engaging with the collar 26, when the holder 30 is inserted in the sleeve 28. The holder 30 has a semi-cylindrical cavity 36, seen in FIG. 1, which is orthogonal to a longitudinal axis 38 of the sleeve 28, and which opens generally at the first end 32 thereof.

In accordance with the invention, the roller 14 is rotatably mounted in the cavity 36 with the ends thereof, such as generally spherical ends 42 and 43 shown in FIG. 2, adjacent or lightly bearing against the inner diameter of the sleeve 28. In this manner, nearly the entire length of the roller 14 serves for making rolling contact with the surface 16 of the camshaft 18. That is, journals for the pin ends as required by prior art constructions, are eliminated in the aforementioned structure. This allows the support structure (the sleeve 28) to be relatively thin-walled and allows adjacent lifter assemblies 10 (not shown) to be positioned significantly closer to one another than are prior art assemblies.

Referring particularly to FIG. 1, it will be seen that the rack 24 can fit in the window 20 and contact the collar 26 with no interference from the sleeve 28. Further, there will be no interference from the roller holder 30, which may be cut away as at cut out 44 to prevent any possible obstruction of the rack 24 and/or the collar 26. It should also be noted that assembly of the lifter assembly 10 is quite straightforward since the roller holder 30 need simply be inserted in the one end 32 of the sleeve 28.

In accordance with the present invention, the lifter assembly 10 may also include means 46 (FIG. 1) for maintaining a selective relative rotational relationship between the sleeve 28 and the holder 30. This assures that the cut out 44 is properly aligned relative to the rack 24. In the particular embodiment illustrated, the rotational relationship retaining means 46 includes an axially extending slot 48 in the sleeve 28 and a co-aligned axially extending slot 50 in the holder 30. A pin 52 (FIG. 1) fits in both of the slots to maintain the relative rotational relationship between the sleeve 28 and the holder 30. Generally, the pin 52 would be press-fitted or otherwise suitably secured in an appropriate bore in a body 54 of the fuel pump 11.

Adverting primarily to FIG. 2, it will be seen that the preferred sleeve 28 has means 64 (FIG. 2) for maintaining holder 30 and sleeve 28 in a selected axial relation, said means 64 being in the form of an inwardly extending ridge 66, against which the holder 30 abuts when inserted into the first end 32 thereof. The assembler simply pushed the holder 30 into the first end 32 of the sleeve 28 until it abuts at ridge 66 and the roller 14, so long as slots 48 and 50 are aligned, is thereby properly positioned for contact with the surface 16 of the camshaft 18. Since holder 30 extends only up to ridge 66, the mass of the overall roller follower lifter assembly 10 is kept relatively lower than it would be if the holder 30 extended a length equal to that of the sleeve 28.

The sleeve 28 can be formed from a piece of tubular stock by drilling inwardly from ends 32 and 34 sufficiently to define ridge 66. The window 20 and slot 48 can be formed by a simple and relatively inexpensive mandrel and die operation. The second end 34 of the sleeve 28 may be counterbored as at 74 to serve for holding a retainer clip 76 (FIG. 1) against which sits a spring 78 of the fuel pump 11.

Alternate Embodiment

Figure 4:
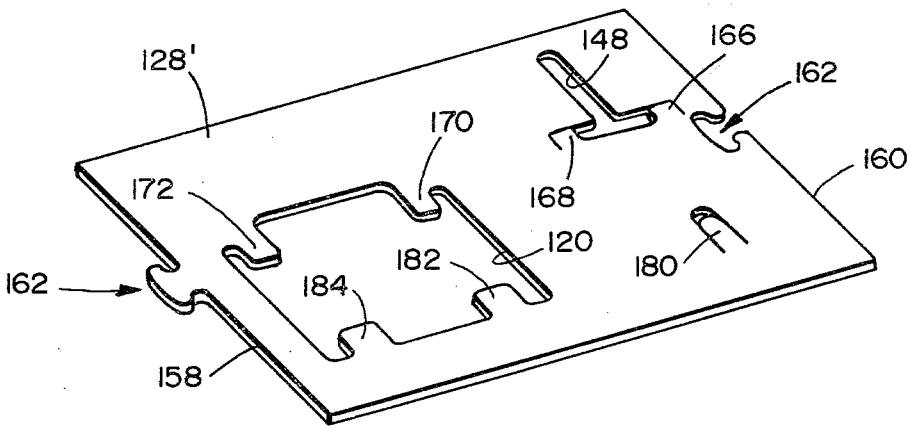
FIG. 4 illustrates, in plane view, the flat sleeve blank prior to its being formed into a cylindrical member.
Figure 3:
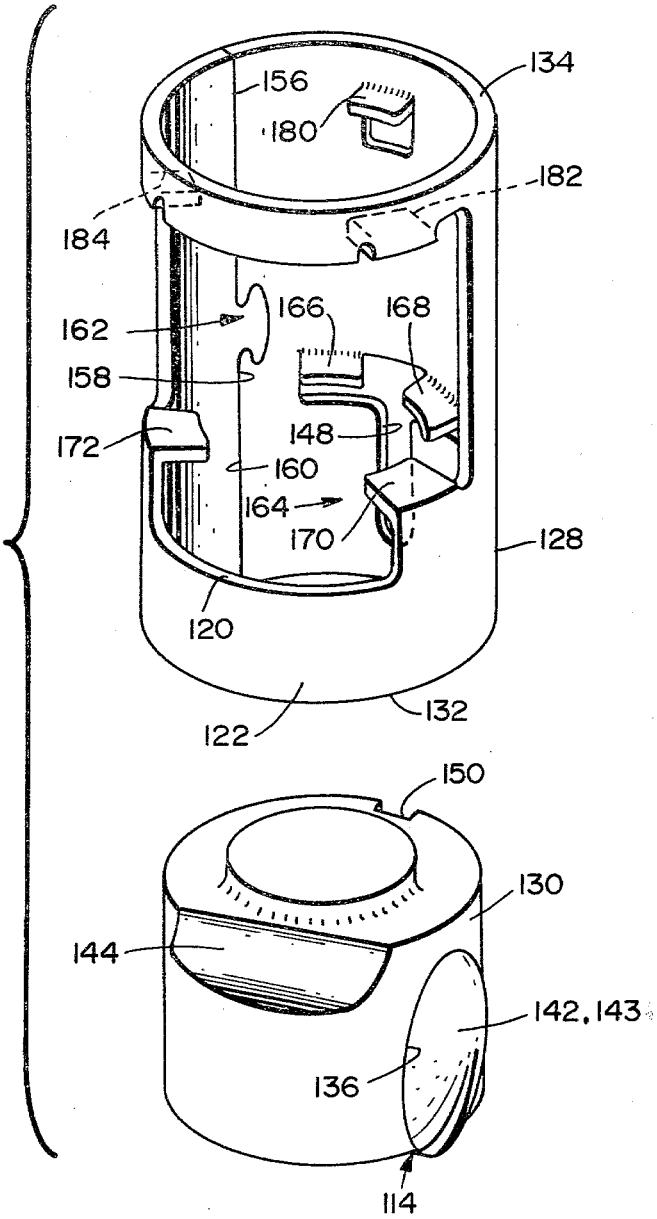
FIG. 3 illustrates, in perspective, a portion of the embodiment of FIG. 2, prior to carrying out of a method in accordance with an embodiment of the present invention.

Referring particularly to FIGS. 3 and 4, it will be seen that an alternate sleeve 128 has an axially extending cut 156 therethrough, from the first end 132 to the second end 134 thereof, formed by a pair of facing abutting edges 158 and 160. The edges 158 and 160 are interlocked together with one another via a lock and tab arrangement 162. Referring to FIG. 4 there is seen therein a relatively thin flat sleeve blank 128' which is adapted to be formed into cylindrical sleeve 128 (FIG. 3). Thus, the cut 156 is preferably present in the sleeve 128 because of its preferred method of manufacture as will be described in more detail below. Further, because the blank 128' is thin, the resulting sleeve 128 is relatively thinwalled and light weight.

Referring to all of the Figures, but primarily to FIGS. 1 and 4, it will be seen that means 164 (FIG. 3) is provided in the form of at least one tab 166, and preferably a plurality of tabs 166,168,170 and 172, which extend radially inwardly from the sleeve 128 and against which the holder 130 abuts when inserted into the first end 132 thereof. The assembler need simply push the holder 130 into the first end 132 of the sleeve 128 until it abuts at the tabs 166,168,170 and 172, and the roller 114 is properly positioned for contact with the surface 16 of the camshaft 18. The roller 114 has somewhat different ends 142,143 (only 142 shown) than does the roller 14. It is noted that the tabs 170 and 172 are positioned so as to co-act with the cut out 144 so as to properly align the roller 114 relative to the slot 148, whereby the axis of the roller 114 is parallel to the axis of the camshaft 18. Thus, the various tabs 166,168,170 and 172 serve as means for maintaining the holder 130 in a selected axial position with respect to the sleeve 128. Since the holder 130 extends only up to the tabs 166,168,170 and 172, the mass of the overall roller follower lifter assembly 10 is kept relatively lower than it would be if the holder 130 extended a length equal to that of the sleeve 128.

One or more tabs 180,182 and 184 in the blank 128' may be bent inwardly on formation of the sleeve 128 to form a support for holding the retainer clip 76.

The Method

Also in accordance with the alternate embodiment of the present invention, a method is presented for forming the sleeve 128. In accordance with the method, the window 120 is stamped or otherwise formed through a generally rectangular piece of metal to provide the blank 128', having at least the one pair of generally parallel edges 158 and 160. The blank 128' is then curled over until the generally parallel edges 158 and 160 abut to form the sleeve 128 in the cylindrical shape shown in FIG. 3. The method may include interlocking the edges 158 and 160 as by the tab and slot arrangement 162. As mentioned above, the sleeve 128 will generally be a part of the lifter assembly 10 for a plunger 12 of a fuel pump 11. In such an application, the method can further include forming at least one tab 166 in the blank 128', and bending the tab 166 to assure that it will extend radially inwardly from the sleeve 128 following the aforementioned curling operation. Generally, each of the tabs 166,168,170 and 172 will be so bent.

After the various tabs 166,168,170 and 172 have been bent, the roller pin holder 130 is inserted in the sleeve 128 from the first end 132 thereof, with the holder 130 already having the roller 114 held in the semi-cylindrical cavity 136 therein. The ends 142 and 143 (not shown) of the roller 114 then are adjacent, and may lightly bear against, the internal diameter of the sleeve 128, with the roller 114 being orthogonal to the sleeve 128 and generally at the first end 132 thereof. The holder 130 is inserted until it contacts the tab 166 and generally also the tabs 168,170 and 172. The blank 128', in the embodiment of FIGS. 3 and 4, has additional tabs 180,182 and 184, which are also bent to extend radially inwardly of the sleeve 128. The tabs 180,182 and 184 serve as alternate means for supporting the retainer clip 76 (see FIG. 1), which in the embodiment of FIGS. 1 and 2 is supported by the counterbore 74.

In accordance with the alternate embodiment of the present invention, the blank 128', with all of the various tabs 166,168,170,172,180,182 and 184 and the window 120 therein, is formed and made in a single stamping operation. In this manner costs are minimized. Further, a relatively thin presleeve 128' can be utilized, since the spherical ends, such as the ends 142 and 143 of the roller 114, need only be held against axial movement of the roller 114 within the sleeve 128 (which is normally externally supported by a bore 86 of the fuel pump 11), as the holder 130 provides the bearing engagement therewith at the semicylindrical cavity 136.

Industrial Applicability

The present invention provides a sleeve 28 or 128 as well as a lifter assembly 10 utilizing such a sleeve 28 or 128. The sleeve 28 or 128 and the lifter assembly 10 are preferably used to motivate the plunger 12 of a fuel pump 11 of a typical engine, for example, a diesel engine. Further, such structures can be used in engine valve trains.

Other aspects, objectives, and advantages of this invention can be obtained from a study of the drawings, the disclosure and the appended claims.

I claim:

1. A lifter assembly (10) comprising:

a sleeve (28 or 128) having a lateral window (20 or 120) therethrough, said sleeve (28 or 128) having an inner diameter and an inner surface;

a roller holder (30 or 130) fitting within said sleeve (28 or 128) from a first end (32 or 132) thereof, said holder (30 or 130) having a generally semi-cylindrical cavity (36 or 136) therein extending nearly the length of said inner diameter and opening generally at said sleeve first end (32 or 132); and a roller (14 or 114) having a roller surface of nearly the full length of said cavity (36 or 136) and being rotatably mounted in said cavity (36 or 136) with ends (42, 43 or 142, 143) of said roller (14 or 114) having outfacing surfaces in facing ralation to and adjacent said inner surface of said sleeve (28 or 128).

2. The lifter assembly (10) as in claim 1, including:

means (46) for maintaining a selected relative rotational relationship between said sleeve (28 or 128) and said holder (30 or 130).

3. A lifter assembly (10) comprising:

a sleeve (28 or 128) having a lateral window (20 or 120) therethrough;

a roller holder (30 or 130) fitting within said sleeve (28 or 128) from a first end (32 or 132) thereof, said holder (30 or 130) having a cavity (36 or 136) therein opening generally at said sleeve first end (32 or 132);

a roller (14 or 114) rotatably mounted in said cavity (36 or 136) with ends (42, 43 or 142, 143) thereof adjacent said sleeve (28 or 128); and means (46) for maintaining a selected relative rotational relationship between said sleeve (28 or 128) and said holder (30 or 130), said maintaining means (46) including an axially extending slot (48 or 148) in said sleeve (28 or 128), a co-aligned axially extending slot (50 or 150) in said holder (30 or 130) and a pin (52) in both said slots (48, 50 or 148, 150).

4. A lifter assembly (10) comprising:

a sleeve (28 or 128) having a lateral window (20 or 120) therethrough, said sleeve (128) having an axially extending cut (156) completely therethrough from said first (132) to a second (134) end thereof formed by a pair of facing abutting edges (158, 160), said edges (158, 160) being interlocked (162) together with one another;

a roller holder (30 or 130) fitting within said sleeve (28 or 128) from a first end (32 or 132) thereof, said holder (30 or 130) having a cavity (36 or 136) therein opening generally at said sleeve first end (32 or 132); and a roller (14 or 114) rotatably mounted in said cavity (36 or 136) with ends (42, 43 or 142, 143) thereof adjacent said sleeve (28 or 128).

5. The lifter assembly (10) as in claim 1, including means (64 or 164) for maintaining said holder (30 or 130) in a selected axial position within said sleeve (28 or 128).

6. The lifter assembly (10) as in claim 5, wherein said means (64) includes a ridge (66) extending radially inwardly from said sleeve (28), and wherein said holder (30) fits within said sleeve (28) up against said ridge (66).

7. The lifter assembly (10) as in claim 5, wherein said means (164) includes at least one tab (166) extending radially inwardly from said sleeve (128), and wherein said holder (130) fits within said sleeve (128) up against said tab (166).

8. In a lifter assembly (10) having a roller (14 or 114) at a first end (32) thereof contacting a cam shaft (18), said assembly (10) motivating a fuel pump (11) plunger (12) to reciprocate, said assembly (10) having a window (20 or 120) through a lateral side (22) thereof through which a motivator (24) fits and engages with said plunger (12), the improvement comprising:

a sleeve (28 or 128) having said window (20 or 120) therethrough, said sleeve (20 or 28) having an inner diameter and an inner surface;

a roller holder (30 or 130) removably fitting within said sleeve (28 or 128) from a first end (32 or 132) thereof to adjacent said window (20 or 120), said holder (30 or 130) being of a construction to not interfere with said motivator (24) when inserted in said sleeve (28 or 128), said holder (30 or 130) having a generally semi-cylindrical cavity (36 or 136) therein extending nearly the length of said inner diameter and opening generally at said first end (32 or 132) of said sleeve (28 or 128); and a roller (14 or 114) having a roller surface of nearly the full length of said cavity (36 or 136), said roller (14 or 114) being rotatably mounted in said cavity (36 or 136) with the ends (42, 43 or 142, 143) of said roller (14 or 114) having outfacing surfaces in facing relation to and adjacent said inner surface of said sleeve (28 or 128).

9. The improvement as in claim 8, including:

means (64 or 164) for maintaining said holder (30 or 130) in a selected axial position within said sleeve (28 or 128).

10. The improvement as in claim 9, wherein said axial position maintaining means (164) includes at least one tab (166) extending radially inwardly from said sleeve (128) and wherein said holder (130) fits within said sleeve (128) up against said tab (166).

11. The improvement as in claim 8, including:

means (46) for maintaining a selected relative rotational relationship between said sleeve (28 or 128) and said holder (30 or 130).

12. The improvement as in claim 8, wherein said sleeve (128) has an axially extending cut (156) therethrough from said first (132) to a second (134) end thereof formed by a pair of facing abutting edges (158,160), and said edges (158,160) are interlocked (162) together with one another.

* * * * *